US006704975B2

(12) United States Patent
Matsumoto et al.

(10) Patent No.: US 6,704,975 B2
(45) Date of Patent: Mar. 16, 2004

(54) SEPARABLE BOTTOM END STOP FOR CONCEALED SLIDE FASTENER

(75) Inventors: Satoshi Matsumoto, Toyama-ken (JP); Kenji Yuki, Toyama-ken (JP); Shigeyoshi Takazawa, Cheshire (GB); Youhei Kaetsu, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/290,806

(22) Filed: Nov. 8, 2002

(65) Prior Publication Data

US 2003/0115725 A1 Jun. 26, 2003

(30) Foreign Application Priority Data

Dec. 20, 2001 (JP) ..... 2001-387948

(51) Int. Cl.[7] ..... A44B 19/38
(52) U.S. Cl. ..... 24/434
(58) Field of Search ..... 24/388, 433–435, 24/432

(56) References Cited

U.S. PATENT DOCUMENTS 3,616,939 A * 11/1971 Potin ..... 24/433
6,112,376 A * 9/2000 Akashi et al. ..... 24/433
6,195,852 B1 * 3/2001 Kusayama ..... 24/434

FOREIGN PATENT DOCUMENTS

EP 1088491 A2 * 4/2001 ..... A44B/19/38
JP 11-155616 6/1999

* cited by examiner

*Primary Examiner*—James R. Brittain
(74) *Attorney, Agent, or Firm*—Bell, Boyd & Lloyd LLC

(57) ABSTRACT

A separable bottom end stop for a concealed slide fastener, wherein reinforcement portions for reinforcing bent edge portions of a fastener tape are molded integrally with a box pin and a separable pin using resin, such that the reinforcement portions are swollen from a top surface of the tape, while the reinforcement portion on the box pin side is formed such that a bottom end thereof is in the same plane as the box pin. A front end of the reinforcement portion on the separable pin side has a protruded portion being protruded in parallel to the separable pin and a box has an L-shaped engaging portion and a contact portion provided on a surface thereof. When the box pin is inserted into and fixed to the box and the separable pin is inserted into the box, the protruded portion makes contact with the engaging portion.

8 Claims, 10 Drawing Sheets

SEPARABLE BOTTOM END STOP FOR CONCEALED SLIDE FASTENER

BACKGROUND OF THE INVENTION

1. Field of the Invention

The present invention relates to a separable bottom end stop for a concealed type slide fastener comprising a box, a box pin and a separable pin, provided at an end of a fastener chain of the concealed slide fastener for separating the closed fastener chain to right/left fastener stringers or closing the open fastener chain by opening/closing operation of the slider.

2. Description of the Related Art

Conventionally, Japanese Patent Application Laid-Open No. 11-155616 (see FIG. 10) has disclosed a separable bottom end stop for a concealed slide fastener comprising a box, a box pin 2' and a separable pin 3', in which reinforcement portions are formed at ends of the fastener tape T' with thermoplastic resin, and the box pin 2' and separable pin 3' easy to handle are formed integrally to the reinforcement portions so that installation of the box to the fastener tape T' can be carried out easily and securely and a mounting portion of the separable pin is unlikely to be deformed.

In the aforementioned separable bottom end stop for the concealed slide fastener, if a strong lateral force is applied to the fastener tape T', the separable pin 3' may sometimes roll in an insertion hole of the box. This phenomenon occurs because stiffness of bent edge portion of the fastener tape T' is insufficient. As evident from FIG. 10, the bent edge portion of the fastener tape T' is formed thin relative to a support portion 22', 23' of the fastener tape T'.

SUMMARY OF THE INVENTION

Accordingly, the invention has been achieved in views of the above-described problems and therefore, a main object of the invention is to provide a separable bottom end stop for a concealed slide fastener, in which bent edge portions of a fastener tape on which a box pin and a separable pin are mounted are reinforced more as compared to a conventional product. As a result, a solid separable bottom end stop is produced thereby achieving smooth, accurate opening/closing operation and eliminating any trouble.

Another object of the invention is to provide a separable bottom end stop for a concealed slide fastener, in which relation with support portions respectively formed at an end of the fastener tape is intensified when the separable pin is engaged with/disengaged from the box, thereby facilitating the gripping and operation of the separable bottom end stop.

Still another object of the invention is to provide a separable bottom end stop for a concealed slide fastener in which specifying the shape of a reinforcement portion on the side of the separable pin enables operation of inserting the separable pin into the box to be carried out smoothly and the separable pin and the box to be maintained in a stable condition, so that the separable pin is prevented from rolling in a separable pin insertion hole when a lateral external force, that is, a lateral pulling force is applied to the separable bottom end stop.

Another object of the invention is to provide a separable bottom end stop for a concealed slide fastener in which engagement and fixation of between the separable pin and the box pin are carried out smoothly and securely and these members are maintained in a stable condition by specifying the shape of a reinforcement portion on the side of the box pin.

A further object of the invention is to provide a separable bottom end stop for a concealed slide fastener in which the box pin, the separable pin, the respective reinforcement portions thereof and the support portions are molded and fixed firmly and effectively to the fastener tape.

A still further object of the invention is to provide a separable bottom end stop for a concealed slide fastener in which the box, the box pin and the reinforcement portion are fixed firmly so as to ensure a sufficient durability.

To achieve the above objects, according to the invention, there is provided a separable bottom end stop for a concealed slide fastener, wherein reinforcement portions for reinforcing bent edge portions of a fastener tape in a separable bottom end stop for a concealed slide fastener without any deformation are respectively molded integrally with a box pin and a separable pin using thermoplastic resin such that the reinforcement portions are swollen from a top surface of the fastener tape when a fastener chain is engaged. Consequently, the bent edge portion of the fastener tape is reinforced by each of the reinforcement portions molded integrally with the box pin and the separable pin, so that the box pin and the separable pin can be maintained in a stable condition, and separation/engagement operation can be executed easily and smoothly. As a result, there is such an effect that a durable separable bottom end stop easy to handle can be produced.

Preferably, the reinforcement portions which are to be formed on the bent edge portions of the fastener tape, are molded integrally with support portions disposed at ends of the fastener tape such that the reinforcement portions are swollen from each surface of the support portions. Consequently, the reinforcement portions can be secured stably at the ends of the fastener tape and additionally, a separable bottom end stop easy to grip with a good feeling can be produced.

Also preferably, the reinforcement portion on the side of the separable pin has a protruded portion whose front end is protruded in parallel to the separable pin and an inside edge of the protruded portion or an edge portion thereof on the side of the support portion is formed so as to be capable of making contact with an inner face of an engaging portion having a convex section, which is protruded in a shape of a letter L on an outside of a surface of the box on the side of a separable pin insertion hole. Consequently, such a simple structure prevents the separable pin from rolling inside the separable pin insertion hole.

Further preferably, the reinforcement portion formed on the bent edge portion of the fastener tape on the side of the separable pin includes a curved portion which is shorter than the separable pin and whose front end is curved slightly inward, and a gap portion having a U-shaped section is provided between the separable pin and the reinforcement portion so that a notch portion of the box and the flange of the slider may be fitted in the gap portion. Consequently, the insertion operation of the separable pin into the box is guided smoothly.

Still further, a hook-shaped engaging portion is provided on an outer face of the box of the separable bottom end stop on the side of an separable pin insertion hole such that it is protruded toward the insertion hole side, so that when the separable pin is inserted into the insertion hole, the curved portion of the reinforcement portion makes contact with the engaging portion. Consequently, if a lateral external force is applied to the separable bottom end stop when the separable pin is inserted into the box, the separable pin is prevented from moving in its removal direction and rolling inside the insertion hole, thereby the separable pin being maintained in a stable condition.

Alternately, the reinforcement portion to be formed on the bent edge portion of the fastener tape on the side of the box pin is formed on the same plane as a bottom end of the box pin and a gap portion having a U-shaped section is provided between the box pin and the reinforcement portion so that an opening provided in the box and the flange of the slider may be fitted in the gap portion. Consequently, setting of the box pin in the box is guided smoothly in a stable condition.

Preferably, a flat contact portion is provided protrudedly on a bottom end of a surface of the box of the separable bottom end stop on the side of a box pin insertion hole, so that when the box pin is inserted into the insertion hole, a bottom end of the reinforcement portion makes contact with the contact portion. Further, an engaging protruded portion protruded inside the insertion hole is provided on an upper part of a mid partition in the box pin insertion hole of the box while an engaging tongue member inclined outward from a front end of the box pin is provided, so that when the box pin is inserted into the insertion hole, the engaging protruded portion and the engaging tongue member are engaged with and fixed to each other. Consequently, the box pin can be set to the box in a stable and firm condition.

Further preferably, joined end portions of the fastener tapes are cut out in a shape of adjoining sides of a triangle when a concealed fastener chain is engaged and closed so as to form notch edge portions, and the box pin, the reinforcement portion and the support portion and the separable pin, the reinforcement portion and the support portion are molded integrally around these notch edge portions using thermoplastic resin. Consequently, the box pin, the reinforcement portion and the support portion and the separable pin, the reinforcement portion and the support portion are molded and fixed firmly on the fastener tapes, thereby achieving production of a good-quality product and effective molding.

Furthermore, after the box pin is inserted into the insertion hole in the box, the box, the box pin and the reinforcement portion are fused together integrally. Consequently, the box, the box pin and the reinforcement portion can be fixed further firmly to the fastener tape, so that a solid, durable separable bottom end stop can be produced.

DESCRIPTION OF THE PREFERRRED EMBODIMENTS

Hereinafter, preferred embodiments of a separable bottom end stop for a concealed slide fastener according to the invention will be described with reference to the accompanying drawings.

Figure 1:
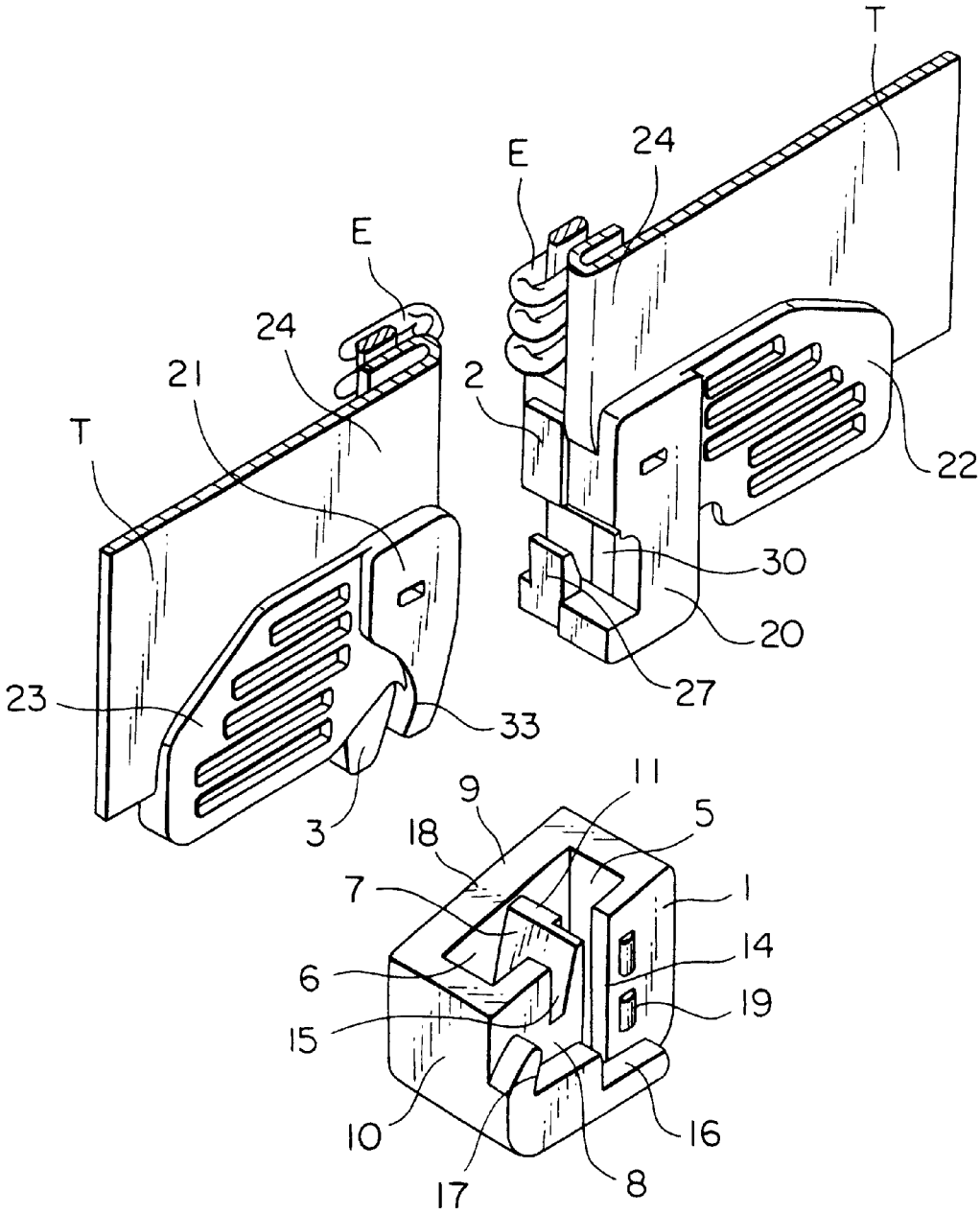
FIG. 1 is an exploded perspective view of a separable bottom end stop for a concealed slide fastener.

As shown in FIG. 1, the separable bottom end stop for the concealed slide fastener of the invention comprises a box 1, a box pin 2 and a separable pin 3. The box 1, the box pin 2 and the separable pin 3 are formed by injection molding using thermoplastic resin such as polyamide, polyacetal, polypropylene, and polybutylene terphthalate. The box pin 2 and the separable pin 3 are formed substantially in a shape of a prism and respectively mounted on a side edge of a fastener tape T by integral molding with coming into contact with fastener elements E continuously. A reinforcement portion 20 is molded integrally with the box pin 2 on a surface of a bent edge portion 24 of the fastener tape T on a side, in which the fastener elements E are not mounted, and a support portion 22 is molded integrally with the reinforcement portion 20 such that it is laterally continuous with the reinforcement portion 20.

As shown in FIG. 1, the box 1 is of a cubic box shape composed of a front wall 8, a rear wall 9 and side walls 10. A box pin insertion hole 5 and a separable pin hole 6 open upward are formed in the box 1 and a mid partition 7 is provided to separate the box pin insertion hole 5 from the separable pin insertion hole 6. An engaging protruded portion 11, which is protruded inside the insertion hole 5, is provided on an upper part of the mid partition 7 on a side of the box pin insertion hole 5. The front wall 8 has an opening 14, which is continuous along and communicate with the box pin insertion hole 5, such that the bent edge portion 24 of the fastener tape T can be inserted into the opening 14.

A notch portion 15, which communicates with the insertion hole 6 and into which the bent edge portion 24 of the fastener tape T is to be inserted, is provided in an upper part of the front wall 8 on a side of the separable pin insertion hole 6. Further, an engaging portion 17, which is protruded upward in a shape of a hook, is provided on the side of the separable pin insertion hole 6 of a lower part of the front wall 8 and a flat contact portion 16, which is dropped downward from the engaging portion 17 and then protruded, is provided on the side of the box pin insertion hole 5 of the front wall 8. This engaging portion 17 engages with a curved portion 33 provided at a front end of a reinforcement portion 21 molded integrally with the separable pin 3. Further, a horizontal bottom end face of the reinforcement portion 20 molded integrally with the box pin 2 contacts the contacting portion 16. In addition, an engaging tongue member 27 provided on the box pin 2 engages with the engaging protruded portion 11 of the mid partition 7 so that it is fixed thereto.

Figure 2:
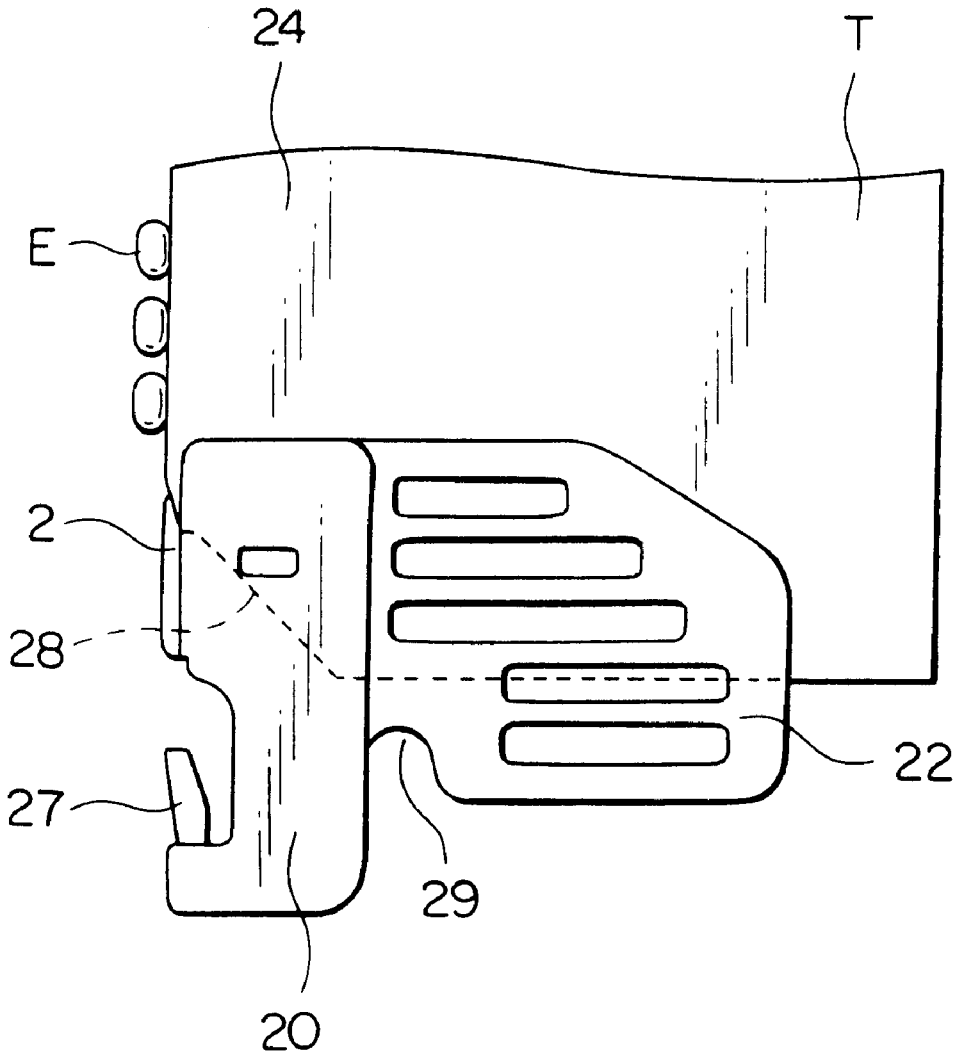
FIG. 2 is a front view of the separable bottom end stop on a box pin side.
Figure 8:
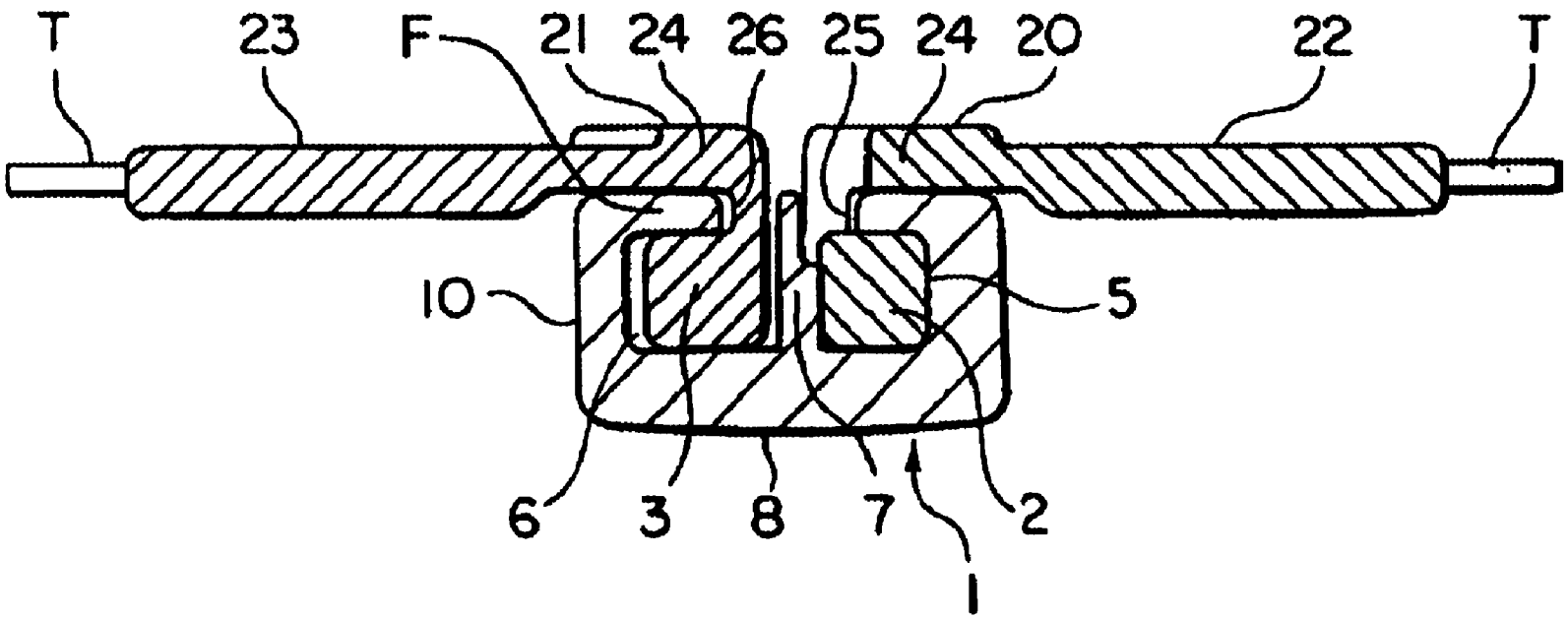
FIG. 8 is a sectional view taken along the line XIII—XIII in FIG. 7.

The engaging tongue member 27, which is protruded upward from a bottom end thereof and inclined toward a front face of the box pin 2, is provided on the front face or a side opposing the separable pin 3. As shown in FIG. 8, a gap portion 25 wider than the thickness of a flange F of a slider S is provided between the box pin 2 and the reinforcement portion 20. The reinforcement portion 20 is formed such that it is swollen from a surface of the fastener tape T so as to make the reinforcement portion 20 thick thereby reinforcing the bent edge portion 24 of the fastener tape T. A support portion 22 is formed integrally with this swollen reinforcement portion 20 such that it is continuous with the reinforcement portion 20 while the surface thereof is dropped further so as to facilitate gripping of the fastener tape T. When the box pin 2, the reinforcement portion 20 and the support portion 22 are formed integrally, as shown in FIG. 2, a notch edge portion 28 is provided by cutting out the corner portion of the fastener tape T. If the box pin 2, the reinforcement portion 20 and the support portion 22 are molded around the notch edge portion 28, a solid product is produced. A dented portion 29 having a curved edge is formed in a joint base portion between the reinforcement portion 20 and the support portion 22 so as to disperse stress applied to the border between the reinforcement portion 20 and the support portion 22 when a lateral external force is applied to the separable bottom end stop, thereby protecting a damage. A through hole 30 is provided in a base portion of the box pin 2 and the reinforcement portion 20.

Figure 3:
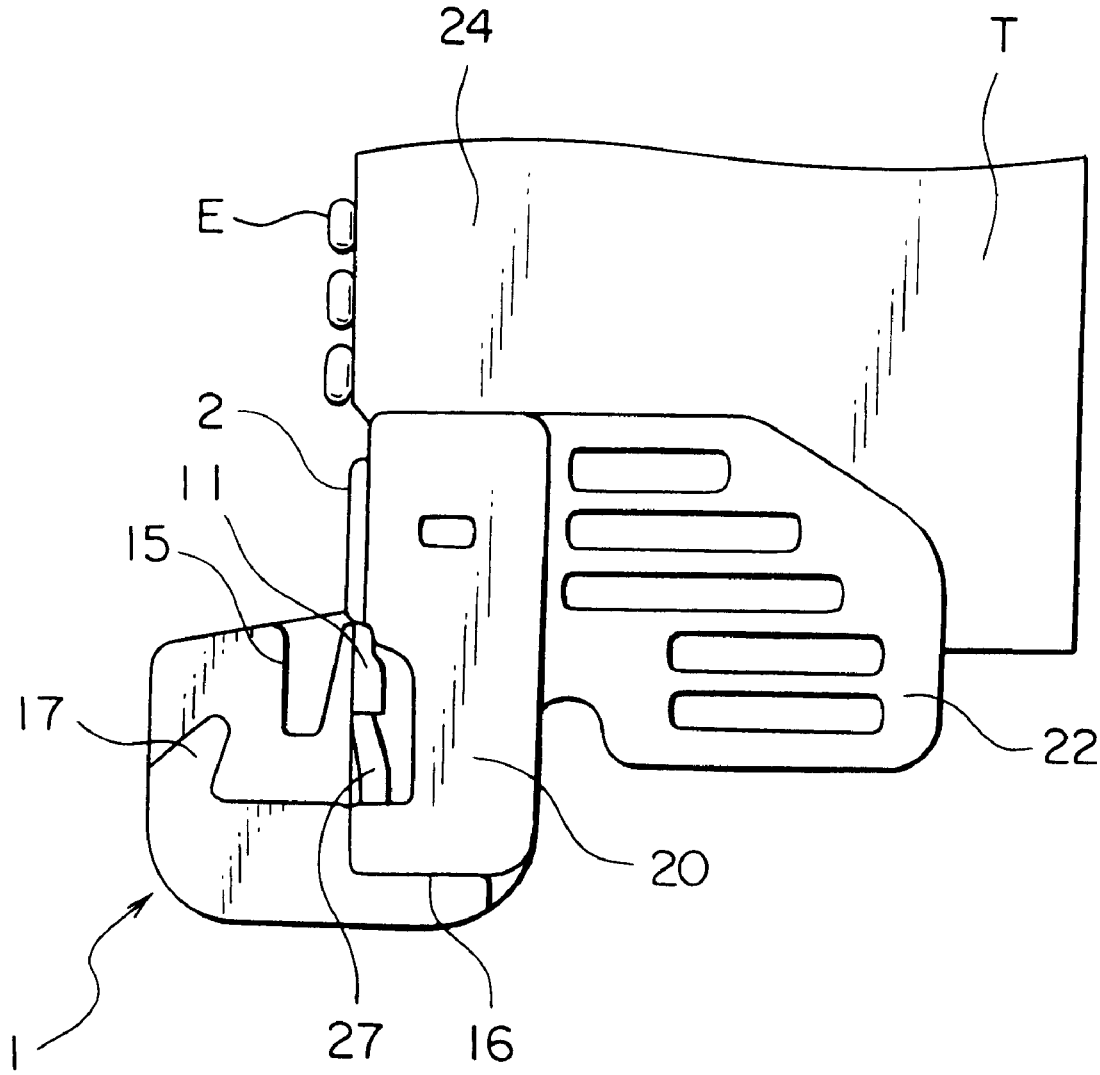
FIG. 3 is a front view of the separable bottom end stop wherein a box and a box pin are set.

To mount the box pin 2 in the box 1, the box pin 2 is inserted firmly into the box pin insertion hole 5 of the box 1 as shown in FIG. 3 and then, the engaging tongue member 27 engages with the engaging protruded portion 11 so that it is fixed thereto. At this time, the gap portion 25 formed between the box pin 2 and the reinforcement portion 20 is inserted along the opening 14 of the box 1 so that the bottom end of the reinforcement portion 20 collides with the contact portion 16 and fixed thereto stably. Provision of small protrusions 19 on the front wall 8 of the box pin insertion hole 5 provides convenience upon fusing the reinforcement portion 20 with the front wall 8 by ultrasonic processing after the box pin 2 and the reinforcement portion 20 are inserted into the box 1.

Meanwhile, the configuration of the box 1 and the box pin 2 is not restricted to the above-mentioned embodiment. The shape and the arrangement of the engaging tongue member 27 and the engaging protruded portion 11 can changed accordingly, if it is intended that the box 1 and the box pin 2 are fixed each other. Alternately, the box 1 and the box pin 2 may be molded integrally.

Figure 4:
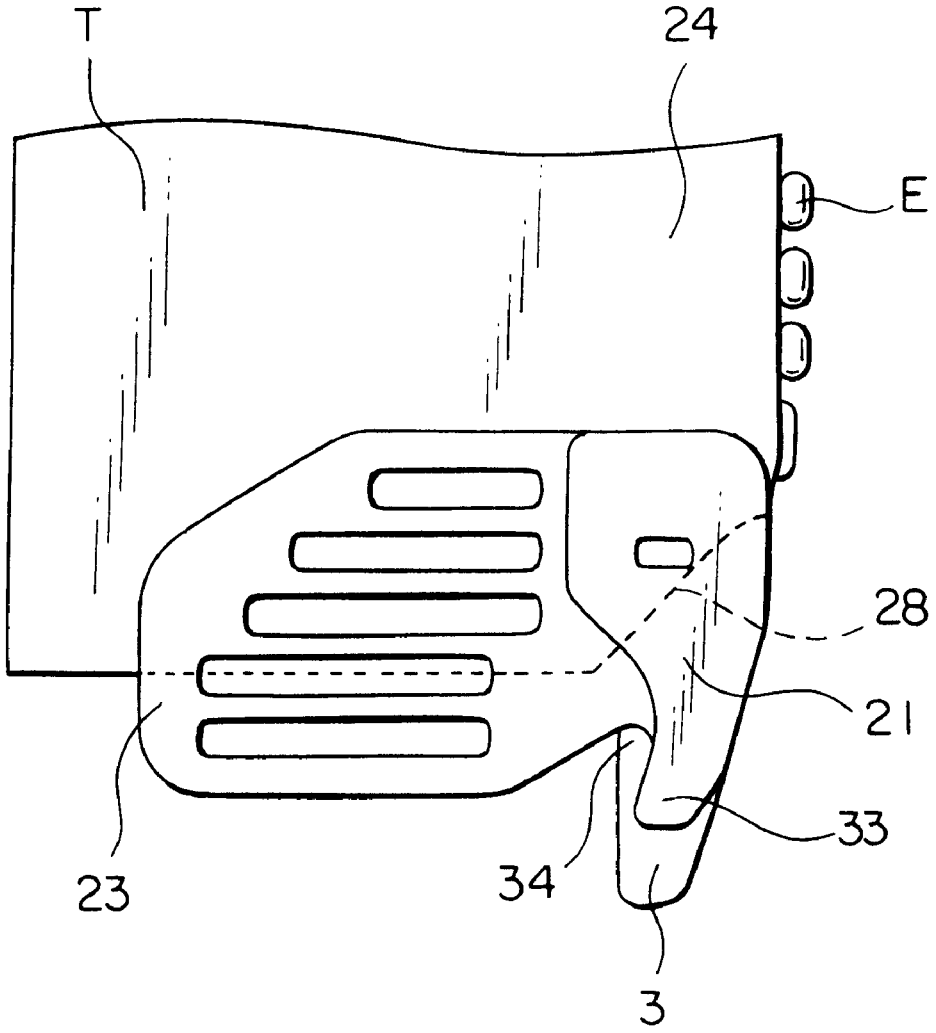
FIG. 4 is a front view of the separable bottom end stop on a separable pin side.
Figure 5:
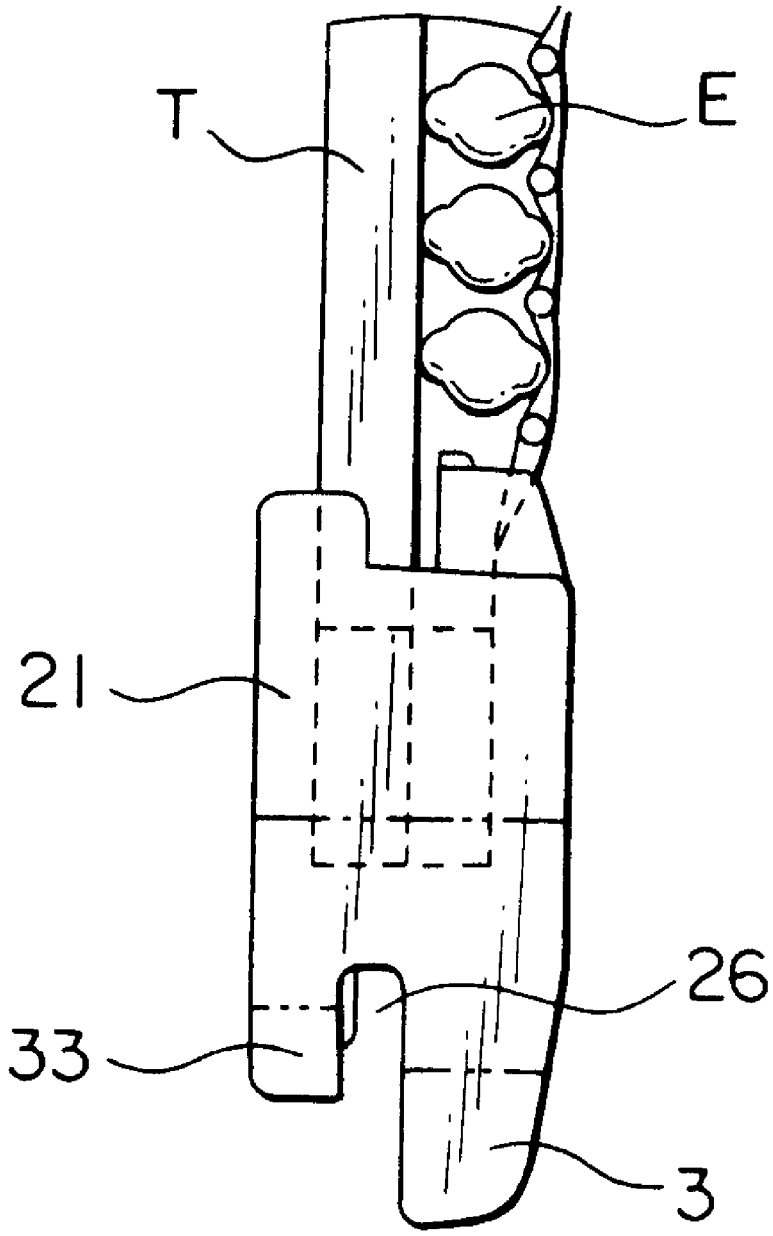
FIG. 5 is a side view of the separable bottom end stop of FIG. 4.

On the other hand, as shown in FIGS. 4 and 5, the separable pin 3 is provided adjacently to the fastener elements E of the fastener tape T and the reinforcement portion 21 is molded on a top surface of the bent edge portion 24 of the fastener tape T adjacently to the separable pin 3 such that it is swollen from the surface. The support portion 23 is molded integrally with the reinforcement portion 21 such that the surface thereof is dropped further thereby facilitating the gripping of the fastener tape T. Like the case of the box pin 2, the corner portion of the fastener tape T is cut out as shown in FIG. 4 so as to provide the notch edge portion 28. By molding the separable pin 3, the reinforcement portion 21 and the support portion 23 around the notch edge portion 28, a solid product is produced.

As shown in FIG. 5, the separable pin 3 and the reinforcement portion 21 are integral with each other and the gap portion 26 having a U-shaped section larger than the thickness of the flange F of the slider S is provided between the separable pin 3 and the reinforcement portion 21. The reinforcement portion 21 has the curved portion 33, which is shorter than the separable pin 3 and the front end of which is curved inward. A dented portion 34 having a curved edge is formed in a joint portion between the curved portion 33 and the support portion 23 at a base portion of the curved portion 33 and the dented portion 34 has the same function as the aforementioned dented portion 29.

Figure 6:
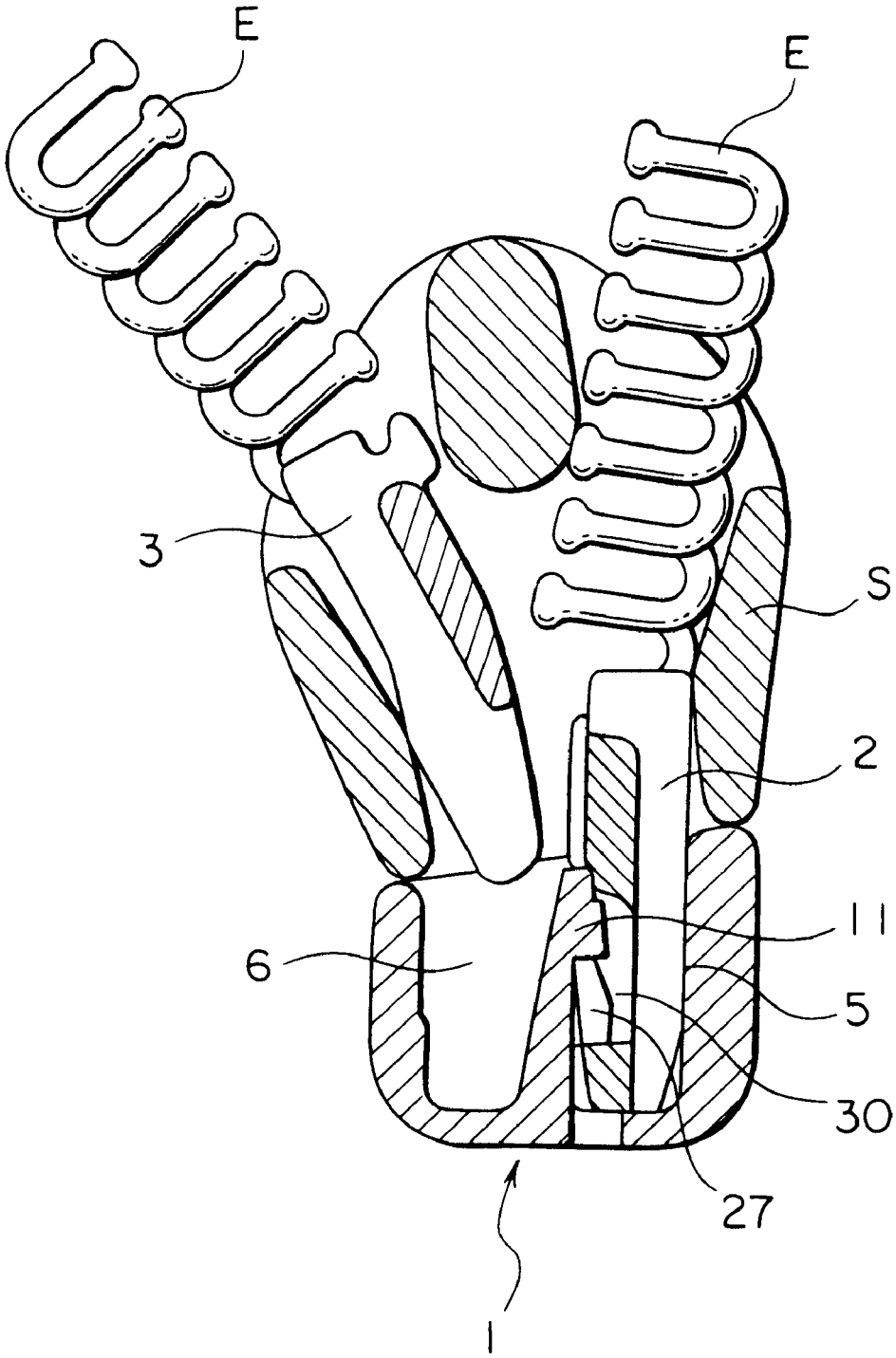
FIG. 6 is a sectional view showing usage condition of the separable bottom end stop.
Figure 7:
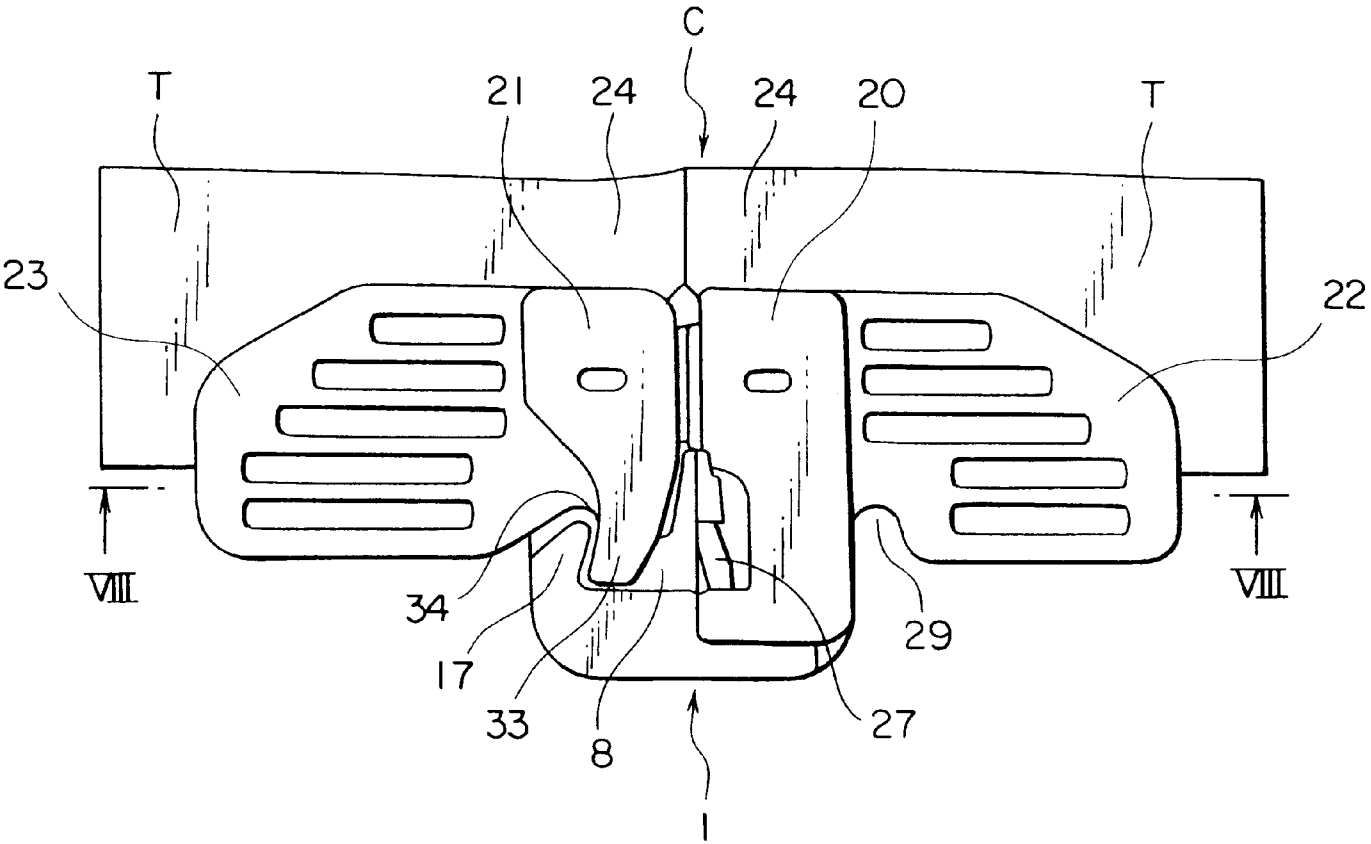
FIG. 7 is a front view of FIG. 6.

As shown in FIG. 6, the separable pin 3 is passed through the interior of the slider S and inserted into the separable pin insertion hole 6 of the box 1. At this time, because the top face of the box 1 is formed in a shape of an inclined portion 18, the slider S in contact with the top face of the box 1 is inclined thereby facilitating the insertion operation of the separable pin. If the insertion of the separable pin 3 is finished, as shown in FIG. 7, the curved portion 33 at the front end of the reinforcement portion 21 of the separable pin 3 engages with the hook-shaped engaging portion 17 provided on the surface of the box 1, so that when the lateral external force is applied to the separable bottom end stop, the separable pin 3 is prevented from rolling inside the insertion hole 6.

(Modification)

Figure 9:
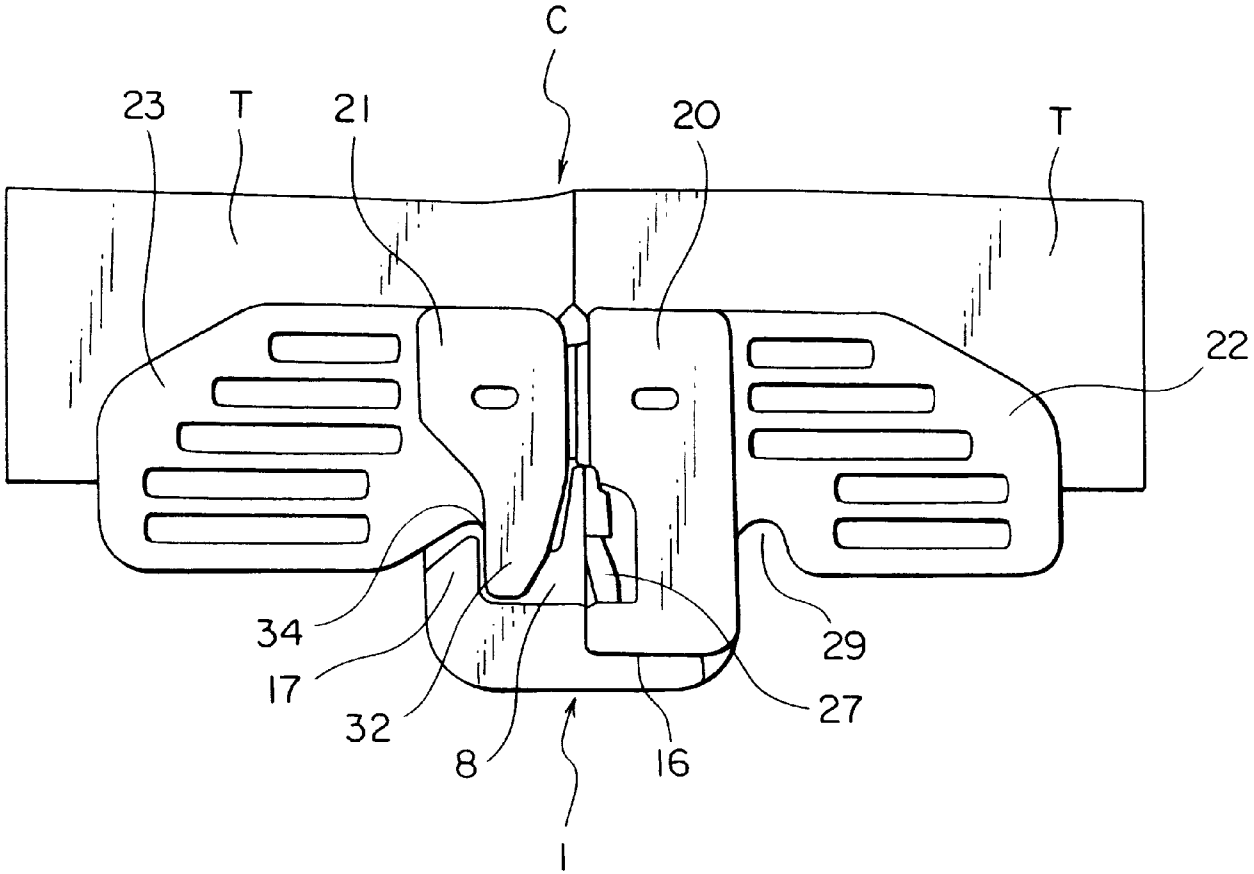
FIG. 9 is a front view showing a modification of the separable bottom end stop.
Figure 10:
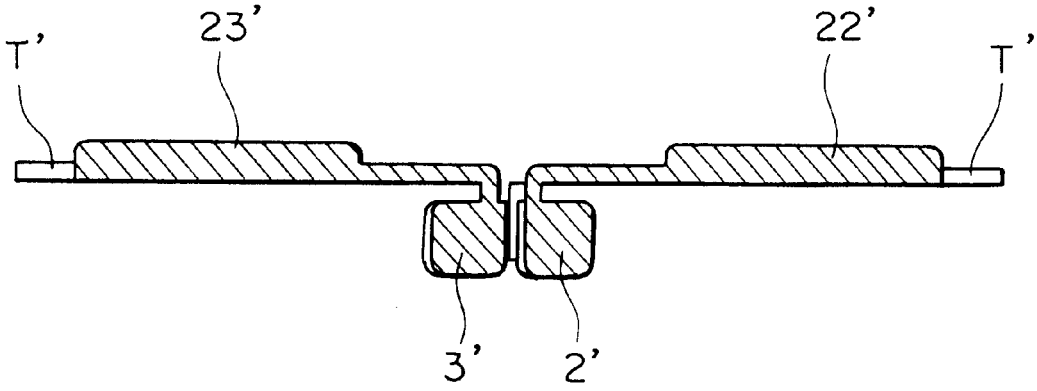
FIG. 10 (PRIOR ART)
FIG. 10 is a sectional view of a well-known separable bottom end stop.

A modification of the engaging portion 17 of the box 1 and the reinforcement portion 21 of the separable pin 3 will be shown next. As shown in FIG. 9, the front end of the reinforcement portion 21 of the separable pin 3 has a protruded portion 32, which is protruded in parallel to the separable pin 3. The inside edge of this protruded portion 32 is extended linearly toward the front end thereof with tapering. The engaging portion 17 on the surface of the box 1 is provided protrudedly in a shape of a letter L on an outside of the box 1 on the side of the separable pin insertion hole 6 such that it has a convex section, so that the inside face of this engaging portion 17 can make contact with a side edge of the protruded portion 32 of the reinforcement portion 21. Since the protruded portion 32 makes contact with the engaging portion 17, the separable pin 3 never rolls inside the separable pin insertion hole 6 even if lateral pulling force is applied thereto.

What is claimed is:

1. A separable bottom end stop for a concealed slide fastener comprising a box, a box pin and a separable pin, wherein reinforcement portions for reinforcing bend edge portions of a fastener tape are respectively molded integrally with the box pin and the separable pin using thermoplastic resin such that the reinforcement portions are swollen from a top surface of the fastener tape, and wherein one of the reinforcement portions which is on a side of the separable pin has a protruded portion whose front end is protruded in parallel to the separable pin and an inside edge of the protruded portion is formed so as to make contact with an engaging portion having a convex section provided on an outside of a surface of the box on the side of a separable pin insertion hole.

2. The separable bottom end stop for the concealed slide fastener according to claim 1, wherein the reinforcement portions are molded integrally with support portions disposed at ends of the fastener tape such that the reinforcement portions are swollen from each surface of the support portions.

3. The separable bottom end stop for the concealed slide fastener according to claim 1, wherein the protruded portion of the reinforcement portion on the side of the separable pin has a curved portion which is shorter than the separable pin and whose front end is curved inward, and a gap portion having a U-shaped section is provided between the separable pin and the reinforcement portion so that a notch portion of the box and a flange of a slider are fitted in the gap portion.

4. The separable bottom end stop for the concealed slide fastener according to claim 1, wherein an engaging portion provided on an outer face of the box is formed in a shape of a hook whose front end is directed inward so that when the separable pin is inserted, the engaging portion makes contact with a curved portion of the reinforcement portion.

5. The separable bottom end stop for the concealed slide fastener according to claim 1, wherein one of the reinforcement portions which is on a side of the box pin formed on the same plane as a bottom end of the box pin has a gap portion having a U-shaped section between the box pin and the reinforcement portion so that an opening provided in the box and a flange of a slider are fitted in the gap portion.

6. The separable bottom end stop for the concealed slide fastener according to claim 1, wherein a flat contact portion is provided protrudedly on a bottom end of a surface of the box on the side of a box pin insertion hole so as to make contact with a bottom end of the reinforcement portion and an engaging protruded portion protruded inward is provided on an upper part of a mid partition in the box pin insertion hole of the box while an engaging tongue member inclined outward from a front end of the box pin is provided, so that when the box pin is inserted, the engaging tongue member is engaged with and fixed to the engaging protruded portion.

7. The separable bottom end stop for the concealed slide fastener according to claim 1, wherein joined end portions of the fastener tapes in a fastener chain are cut out in a shape of adjoining sides of a triangle so as to provide notch edge portions, and the box pin, the reinforcement portion a support portion, and the separable pin, the reinforcement portion and a support portion are molded integrally around the notch edge portions using thermoplastic resin.

8. The separable bottom end stop for the concealed slide fastener according to claim 1, being characterized in that after the box pin is inserted into the box, the box, the box pin and the reinforcement portion are fused together.

* * * * *